US007275656B1

(12) United States Patent
Samadani

(10) Patent No.: US 7,275,656 B1
(45) Date of Patent: Oct. 2, 2007

(54) TISSUE BOX HOLDER

(76) Inventor: Amanollah Samadani, 1333 Gough St., #1-C, San Francisco, CA (US) 94109

( * ) Notice: Subject to any disclaimer, the term of this patent is extended or adjusted under 35 U.S.C. 154(b) by 0 days.

(21) Appl. No.: 11/383,714

(22) Filed: May 16, 2006

(51) Int. Cl.
*A47K 10/24* (2006.01)
*B65H 1/00* (2006.01)

(52) U.S. Cl. ..... 221/45; 206/292; 206/294; 206/514; 206/515; 221/33; 221/46

(58) Field of Classification Search ..... 221/1–311; 206/294, 505, 514–520; D9/744
See application file for complete search history.

(56) References Cited

U.S. PATENT DOCUMENTS

| | | | | |
|---|---|---|---|---|
| 1,901,006 | A | 3/1933 | Spain | |
| 2,598,050 | A | 5/1952 | Guyer | |
| 2,738,942 | A | 3/1956 | Gantner | |
| 2,882,113 | A * | 4/1959 | Gantner | 312/248 |
| 2,911,175 | A * | 11/1959 | Erie | 248/217.2 |
| 2,990,950 | A | 7/1961 | Alexander | |
| 3,043,472 | A | 7/1962 | Nemoede | |
| 3,258,156 | A | 6/1966 | Larkin | |
| 3,482,734 | A | 12/1969 | Mierson | |
| 3,482,810 | A * | 12/1969 | Bailey | 248/311.2 |
| 3,628,691 | A * | 12/1971 | Hillman | 221/45 |
| 3,917,207 | A * | 11/1975 | Quigley | 248/311.2 |
| 5,213,243 | A * | 5/1993 | Landon | 224/277 |
| 5,462,197 | A | 10/1995 | Pound | |
| D374,360 | S * | 10/1996 | Angermeir | D6/518 |
| 5,613,608 | A * | 3/1997 | Tronchetti et al. | 206/494 |
| 6,170,725 | B1 | 1/2001 | Ganues | |
| 6,267,262 | B1 * | 7/2001 | Wilner | 221/45 |
| 6,364,185 | B2 * | 4/2002 | Wu | 224/572 |
| 6,561,378 | B1 * | 5/2003 | Roessler et al. | 221/45 |
| 2002/0139705 | A1 * | 10/2002 | Hajianpour | 206/494 |
| 2006/0096998 | A1 * | 5/2006 | Shabashkevich | 221/45 |

* cited by examiner

*Primary Examiner*—Gene O. Crawford
*Assistant Examiner*—Michael K Collins
(74) *Attorney, Agent, or Firm*—Roger Chu

(57) ABSTRACT

A tissue box holder that has a substantially similar shape of commercially available tissue box is described. In one embodiment, the holder is substantially slab-shaped with two opposing side faces, a front flap that can be opened and/or closed, a rear edge face, a bottom face with at least one attach means and a top face with an open slot that allows tissues to be retrieved or pulled out sequentially. The holder is made of sturdy material such as plastics, leathers, or the likes. The holder can be attached to a number of different surfaces such as interior surfaces of a vehicle, a wheel chair, and an office of doctor's office. The open slot is designed such that the tissue box can be inserted after the tissue box has already opened with tissues sticking out.

16 Claims, 4 Drawing Sheets

100

100

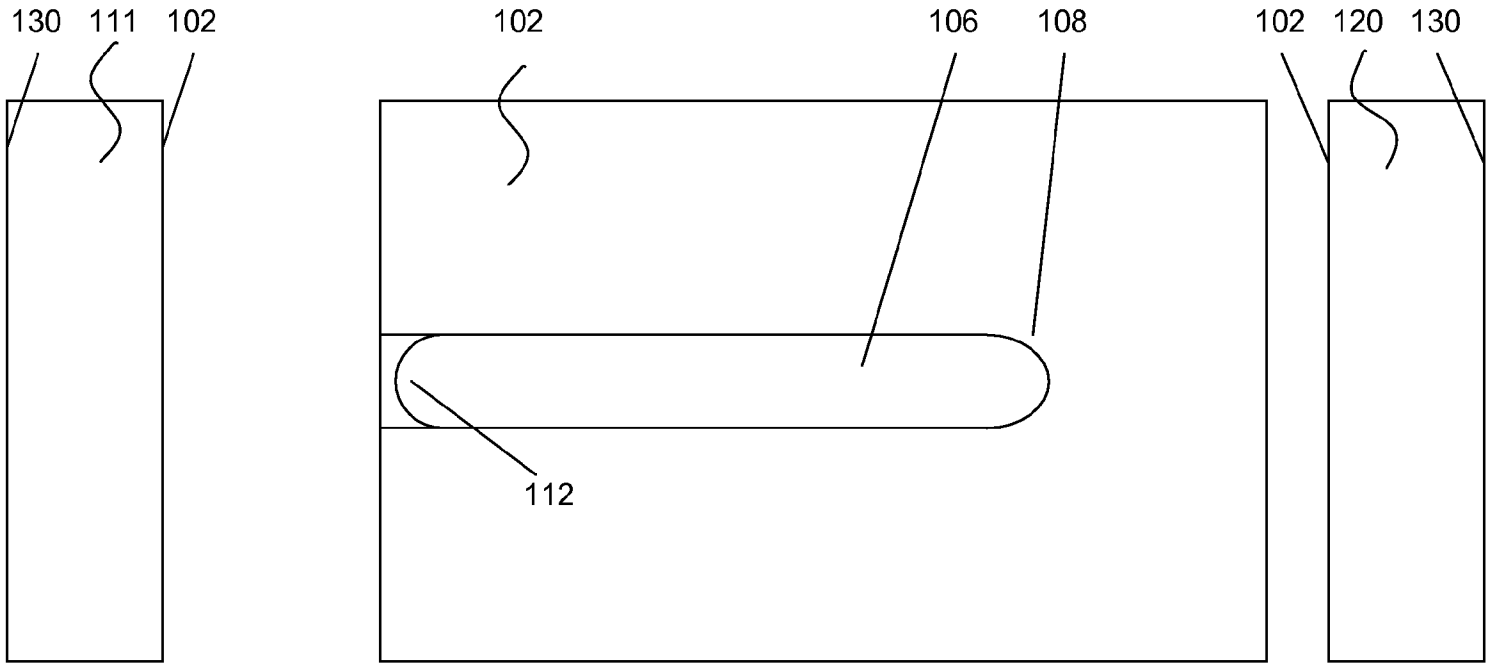
FIG. 3B
FIG. 3A
FIG. 3C
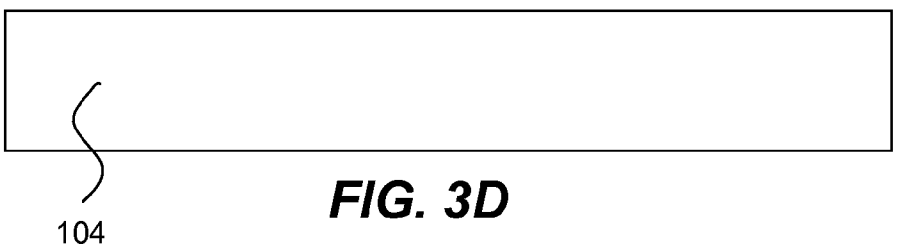
FIG. 3D

TISSUE BOX HOLDER

BACKGROUND

The present invention generally relates to tissue box holder, more particularly to, a tissue box holder that can be attached to a surface to allow convenient access by consumers.

Commercially available tissues are stored in a paper box. Generally, the paper box is designed to be used in a steady environment such as office, classroom, home. When consumers put a box of tissues in a moving environment such as a car, there is no convenient location designated for the tissue box. Often time, the box ends up on the floor due to the vehicle movements. As a result, the box is stepped on by vehicle occupants. Not only the box is deformed, but tissues are contaminated and rendered unusable. Therefore, there is a need to secure a box of tissues in a convenient location within a moving environment. In many environments such as doctor's and dentist's offices, it would be convenient to access tissues with one hand. Without attaching a tissue box to a surface, it is often required two hands to access a sheet of tissue especially when tissues are almost run out in the box.

Therefore, it would be desirable to have a tissue box holder that can be attached to a surface to allow convenient access.

SUMMARY

This section is for the purpose of summarizing some aspects of the present invention and to briefly introduce some preferred embodiments. Simplifications or omissions in this section as well as in the abstract and the title herein may be made to avoid obscuring the purpose of the section. Such simplifications or omissions are not intended to limit the scope of the present invention.

The present invention discloses a tissue box holder that has a substantially similar shape of commercially available tissue box. According to one aspect, the box holder is substantially slab-shaped with two opposing side faces, a front flap that can be opened and/or closed, a rear edge face, a bottom face with at least one attach means and a top face with an open slot or aperture that allows tissues to be retrieved or pulled out sequentially. The tissue box holder is made of sturdy material such as plastics, leathers, or the likes. The flap is hingedly connected to the bottom face and the flap is generally closed in a normal configuration. The flap is opened for insertion and removal of the tissue box. The open slot or aperture has an open end at the front edge of the top face and the centerline of the open slot is substantially perpendicular to the front edge. The attach means allows the holder to be attached to surfaces such as metals, upholstery fabrics, plastics, vinyl, glass, and the likes.

According to one embodiment, the present invention is a tissue box holder for holding a box of tissues, the holder includes at least the following: a substantially slab-shaped box with two opposing side faces, a bottom face, a top face having an open slot whose centerline is perpendicular to front edge of the top face, a rear edge face and a flap hingedly connected to the bottom face, wherein the open slot has an open end at the front edge of the top face; and at least one attach means coupling to the bottom face.

One of the objects, features, and advantages of the present invention is to allow easy access of tissues in a moving environment such as inside of a vehicle, as well as the low cost and affordability which can replace contaminated and smashed tissue boxes in a moving vehicle hence promoting public health.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will be become better understood with regard to the following description, appended claims, and accompanying drawings where:

FIGS. 3A-3D show a top view and three side elevation views of the tissue box holder of FIG. 1 with the flap is closed, respectively.

DESCRIPTION

In the following description, numerous specific details are set forth in order to provide a thorough understanding of the present invention. However, it will become obvious to those skilled in the art that the present invention may be practiced without these specific details. The descriptions and representations herein are the common means used by those experienced or skilled in the art to most effectively convey the substance of their work to others skilled in the art. In other instances, well-known methods, procedures, and components have not been described in detail to avoid unnecessarily obscuring aspects of the present invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention does not inherently indicate any particular order nor imply any limitations in the invention.

Embodiments of the present invention are discussed herein with reference to FIGS. 1-4. However, those skilled in the art will readily appreciate that the detailed description given herein with respect to these figures is for explanatory purposes as the invention extends beyond these limited embodiments.

Figure 1:
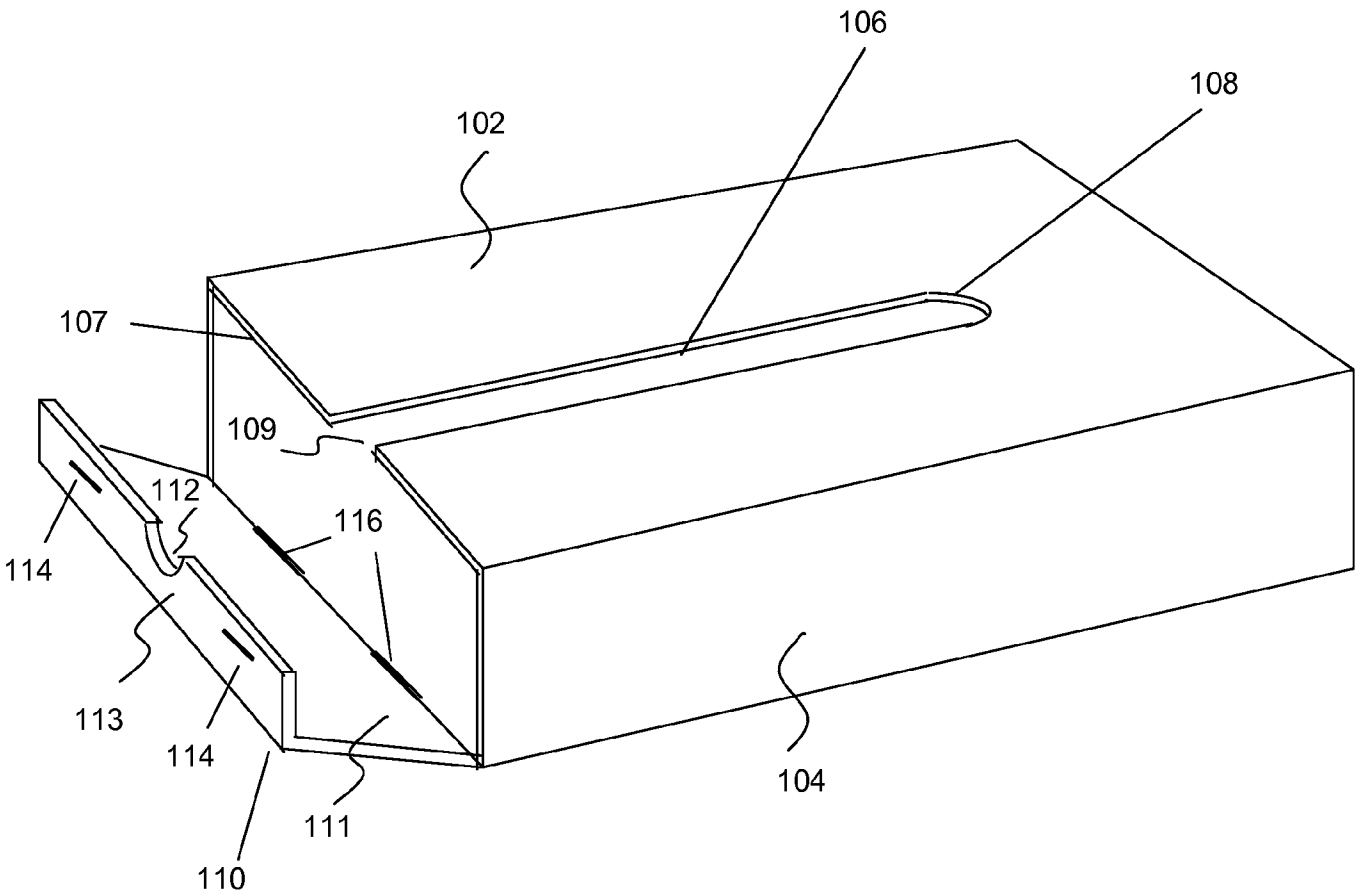
FIG. 1 shows a perspective view of a tissue box holder with flap opened in accordance with one embodiment of the present invention.

Referring now to the drawings, in which like numerals refer to like parts throughout several views. FIG. 1 shows a perspective view of a tissue box holder 100 with flap opened in accordance with one embodiment of the present invention. Inner dimensions of the tissue box holder 100 are designed to be substantially similar to outside dimensions of a commercially available tissue box, so that the tissue box can be inserted into the holder 100. In one embodiment, the holder 100 is a substantially slab-shaped with a top face 102, a bottom face (130 of FIG. 4), a flap 110 at front edge 107 of the top face 102, a rear edge face (120 of FIG. 2) and two opposing substantially similar side faces (only one side face 104 is shown). The top face 102 has an open slot or aperture 106 whose centerline is substantially perpendicular to the front edge 107 of the top face 102. In one embodiment, the open slot 106 has a U-shape with one open end 109 at the front edge 107 of the top face 102 and a closed end 108 at the opposite direction. The shape of the closed end 108 include, not be limited to, semi-circle, pointed V-shape, rounded corner U-shape, sharp corners, and alike. The length and width of the open slot 109 are chosen such that the tissues can be retrieved sequentially through the open slot 106 without any difficulty. The open end 109 is designed such that a tissue box can be inserted into the holder 100 after the tissue box has already opened with tissues sticking out.

The bottom face 130 includes at least one attach means 138 to be used for attaching the holder 100 to a number of surfaces. The flap 110 includes two elements: a front edge face 111 and a ledge 113 fixed couple to each other at one side in a substantially perpendicular orientation. At the opposite side, the front edge face 111 is hingedly connected 116 to the bottom face 130, so that the flap 110 can be opened for insertion and removal of a tissue box into the holder 100, and free edge of the ledge 113 is designed to be inserted into the holder 100 when the flap 110 is closed in normal configuration. A notch 112 is optionally provided in the center of the free edge of the ledge 113. The notch 112 may have a mirror-image shape of the closed end 108 of the open slot 106, so that the open slot 106 has a symmetrical aperture. In order to keep the flap 110 secure when inserted into the holder 100, the ledge 113 includes at least one latch means 114.

Figure 2C:
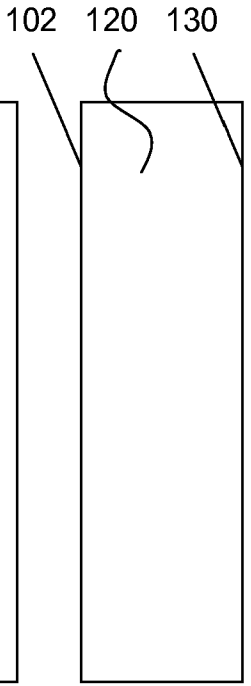
FIGS. 2A-2D show a top and three side elevation views of the tissue box holder of FIG. 1 with the flap is opened, respectively.
Figure 2A:
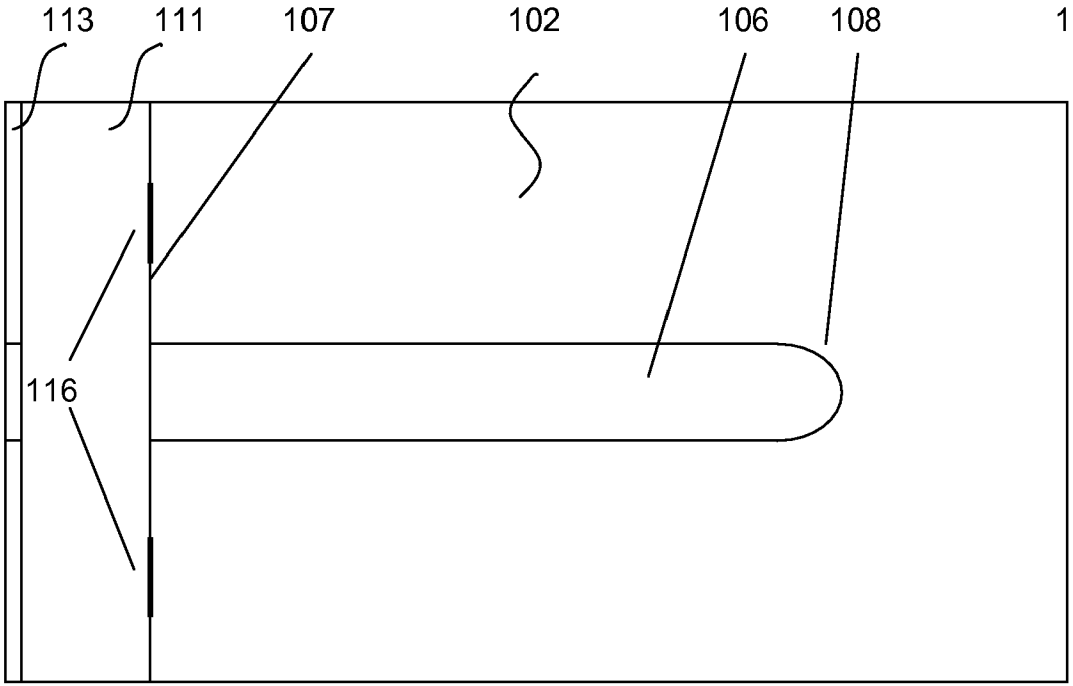
Figure 2B:
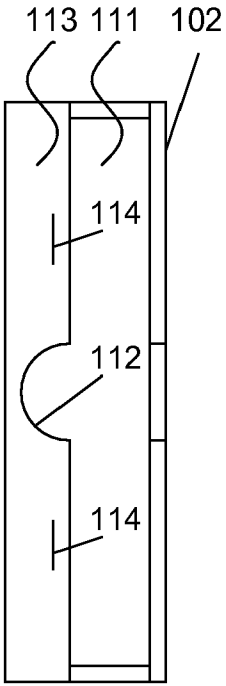
Figure 2D:
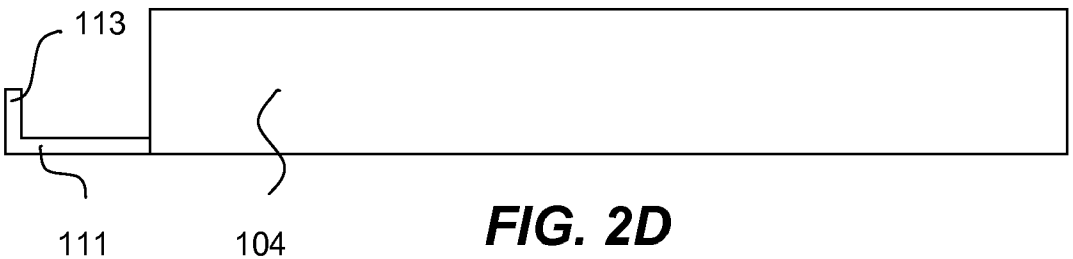

FIGS. 2A-2D show one top and three side elevation views of the tissue box holder 100 with the flap 110 is opened, respectively. FIG. 2A is the top view of the top face 102, FIG. 2B is the elevation view of the front edge face 111, FIG. 2C is the elevation view of the rear edge face 120, and FIG. 2D is the elevation view of the side face 104. Due to symmetry, the elevation view of the side face opposite to the side face 104 is the mirror image of FIG. 2D.

FIGS. 3A-3D show a top view and three side elevation views of the tissue box holder 100 with the flap 110 is closed, respectively. FIG. 3A is the top view of the top face 102, FIG. 3B is the elevation view of the front edge face 111, FIG. 3C is the elevation view of the rear edge face 120, and FIG. 3D is the elevation view of the side face 104. Due to symmetry, the elevation view of the side face opposite to the side face 104 is the mirror image of FIG. 2D.

Figure 4:
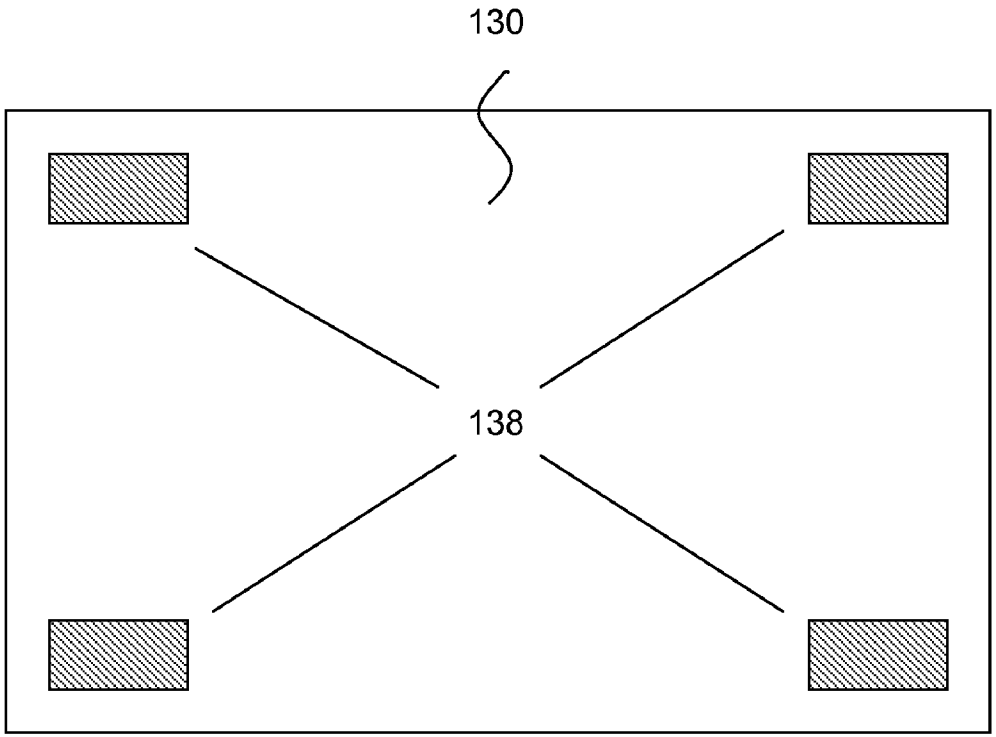
FIG. 4 shows a bottom view of the tissue box holder of FIG. 1 with the flap is closed.

FIG. 4 shows a bottom view of the tissue box holder 100 with the flap 110 is closed. The bottom face 130 includes at least one attach means 138, which may include, but not be limited to, Velcro®, magnets, 2-sided glue strips, and alike. The attach means 138 is designed for attaching the holder 100 to a surface including, but not be limited to, metals, upholstery fabrics, plastics, glass, and the likes. In one embodiment, the holder 100 is attached to the interior roof of an automobile via the attach means 138 of the bottom face 130, so that tissues can be retrieved or pulled out conveniently through the open slot 106 of the top face 102. In another embodiment, the holder 100 is attached to the back of a car seat (e.g., the front driver or passer seat) such that tissues can be easily pulled out by passengers occupied in the rows behind. In yet another embodiment, the holder 100 can be attached to a wheel chair, so that the user of the wheel chair can access tissues with one hand in a pre-designed location on the wheel chair.

The tissue box holder 100 of present invention is made of sturdy materials such as plastics, leathers, or the likes. In one embodiment, the holder 100 is made of glowing material, which can be easily visible in the dark. Although, in the embodiment described above, the tissue box holder 100 is a substantially slab-shaped box, the present invention does not limit to any shape or size. Tissue boxes for other practical shapes and sizes are included in the spirit of the present invention and should be appreciated with those skilled in the art.

Although an exemplary embodiment of invention has been disclosed, it will be apparent to those skilled in the art that various changes and modifications may be made to achieve the advantage of the invention. It will be obvious to those skilled in the art that some components may be substituted with another component providing same function. The appended claims cover the present invention.

What is claimed is:

1. A tissue box holder for holding a box of tissues, the holder comprising:

a substantially slab-shaped box with two opposing side faces, a bottom face, a top face having an open slot whose centerline is perpendicular to the front edge of the top face, a rear edge face and a flap hingedly connected to the bottom face, wherein the open slot has an open end at the front edge of the top face, and wherein the flap comprises a front edge face and a ledge fixedly connected to each other perpendicular, and the ledge further comprises a notch having a shape substantially similar to the shape of the close end of the open slot in a mirror image orientation; and at least one attach means coupling to the bottom face.

2. The holder of claim 1, wherein the holder is symmetrical with respect to the center line of the open slot.

3. The holder of claim 2, wherein the two opposing side faces are substantially similar to each other.

4. The holder of claim 1, wherein the opening slot has dimensions chosen such that the tissues can be retrieved or pulled out sequentially.

5. The holder of claim 4, wherein the open end of the opening slot is provided for allowing insertion of an already opened box of tissues.

6. The holder of claim 1, wherein the opening slot has a closed end opposite to the open end.

7. The holder of claim 6, wherein the close end has a shape selected from a group consisting of semi-circle, rounder corner U-shape, pointed V-shape, and sharp corners.

8. The holder of claim 1, wherein the flap can be opened for insertion and removal of the box of tissues.

9. The holder of claim 1, wherein the ledge has a free edge to be inserted into the inside of the holder under the top face.

10. The holder of claim 9, wherein the ledge includes at least one latch means.

11. The holder of claim 10, wherein the at least one latch means is used for securing the flap in a closed configuration.

12. The holder of claim 1, wherein the at least one attach means is used to secure the bottom face of the holder to a surface.

13. The holder of claim 12, wherein the surface is selected from a group consisting of metals, upholstery fabrics, plastics, glass and vinyl.

14. The holder of claim 1, wherein the at least one attach means is selected from a group consisting of Velcro®, 2-sided glue strip, and magnet.

15. The holder of claim 1, wherein the holder is made of sturdy material selected from a group that consists of plastics and leathers.

16. The holder of claim 15, wherein the sturdy material is glowing.

* * * * *